US008151543B2

(12) United States Patent
Veix

(10) Patent No.: US 8,151,543 B2
(45) Date of Patent: Apr. 10, 2012

(54) BAG CLAMP PUCKERING SYSTEM

(75) Inventor: Scott Veix, Bradenton, FL (US)

(73) Assignee: KHS GmbH, Dortmund (DE)

( * ) Notice: Subject to any disclaimer, the term of this patent is extended or adjusted under 35 U.S.C. 154(b) by 203 days.

(21) Appl. No.: 12/764,271

(22) Filed: Apr. 21, 2010

(65) Prior Publication Data

US 2010/0269458 A1 Oct. 28, 2010

Related U.S. Application Data

(60) Provisional application No. 61/171,582, filed on Apr. 22, 2009.

(51) Int. Cl.
*B65B 57/02* (2006.01)
*B65B 59/00* (2006.01)
*B65B 43/46* (2006.01)

(52) U.S. Cl. ..... 53/64; 53/570; 53/384.1; 53/386.1; 141/166

(58) Field of Classification Search ..... 53/64, 570, 53/284.7, 384.1, 386.1; 141/114, 166, 313, 141/314; *B65B 43/26, 43/28, 43/42, 43/46*
See application file for complete search history.

(56) References Cited

U.S. PATENT DOCUMENTS

| | | | | | |
|---|---|---|---|---|---|
| 2,722,358 | A | * | 11/1955 | Wilson | 53/385.1 |
| RE26,553 | E | * | 3/1969 | Nutting et al. | 53/562 |
| 3,430,414 | A | * | 3/1969 | Ludwig et al. | 53/79 |
| 3,568,402 | A | * | 3/1971 | Lense et al. | 53/384.1 |
| 3,700,388 | A | * | 10/1972 | Johnson et al. | 53/562 |
| 3,855,907 | A | * | 12/1974 | Johnson et al. | 53/570 |
| 4,033,093 | A | * | 7/1977 | Mencacci | 53/571 |
| 4,108,300 | A | * | 8/1978 | Hayase et al. | 53/570 |
| 4,263,768 | A | * | 4/1981 | Russell et al. | 53/384.1 |
| 4,353,198 | A | * | 10/1982 | Koppe | 53/570 |
| 4,423,583 | A | * | 1/1984 | Carey | 53/570 |
| 4,608,803 | A | * | 9/1986 | Araki | 53/202 |
| 5,058,364 | A | * | 10/1991 | Seiden et al. | 53/570 |
| 5,222,535 | A | * | 6/1993 | Roders | 141/314 |
| 5,845,466 | A | * | 12/1998 | Laudenberg | 53/570 |
| 5,862,653 | A | * | 1/1999 | Solano | 53/284.7 |
| 6,073,424 | A | * | 6/2000 | Kraft et al. | 53/570 |
| 6,276,117 | B1 | * | 8/2001 | Wiles | 53/570 |
| 2001/0010142 | A1 | * | 8/2001 | Todd et al. | 53/64 |
| 2002/0144880 | A1 | * | 10/2002 | Ikemoto et al. | 198/469.1 |

FOREIGN PATENT DOCUMENTS

| | | | | |
|---|---|---|---|---|
| JP | 03176340 | A | * 7/1991 | 53/386.1 |
| JP | 03226434 | A | * 10/1991 | |

* cited by examiner

*Primary Examiner* — Stephen F Gerrity
(74) *Attorney, Agent, or Firm* — Andrew Wilford

(57) ABSTRACT

A bag-puckering system has a pairs of grippers engageable with upper corners of respective bags. The grippers of each pair are shiftable between an inner position in which the respective bag is puckered open and an outer position in which the respective bag is held flat. The pairs of grippers are aligned in a longitudinal row and shiftable in a travel direction through a filling station wherein fluent material can be poured into the bags. A controller upstream of the filling station measures a length in the direction of the bags and generates respective outputs corresponding thereto. A movable cam at the filling station operatively engages the grippers in the filling station for shifting the grippers between their inner and outer positions. A drive connected to the control means and to the cam can shift the grippers in accordance with the size of the respective bags.

9 Claims, 10 Drawing Sheets

BAG CLAMP PUCKERING SYSTEM

CROSS-REFERENCE TO RELATED APPLICATION

This application is related to copending provisional application 61/171,582 filed 22 Apr. 2009.

FIELD OF THE INVENTION

The present invention relates to a bag-puckering system. More particularly this invention concerns such a system used on a bag-filling machine.

BACKGROUND OF THE INVENTION

All bag filling machines require the handling of the bag from a tight or closed condition to a puckered or open condition to allow a normally fluent product, e.g. cat litter, to be loaded into the bag, the bag then being reclosed to allow for final sealing. This process is accomplished by the use of a puckering system comprising a plurality of pairs of bag grippers. The grippers of each pair holding opposite top corners of the bag in spring loaded jaws. In a starting position the grippers are spaced well apart and hold the front and back panels taut and planar, resting flatly against each other with the bag flat and closed. When the two grippers move together, the bag puckers and the front and back panels can move apart, typically aided by front and back suction grippers that engage the respective panels and pull them apart transversely to the plane of the closed bag. The pairs of grippers normally follow a closed path through the filling machine with the closed bags lying in planes parallel to the transport direction.

The normal method for bag puckering with such bag grippers requires a considerable spacing between the trailing gripper of the leading pair and the leading gripper of the next trailing pair so as to not affect the next bag gripper pair when actuating the preceding pair. Usually the bag fed into the bag gripper puckering system has different sizes, more particularly in its transverse direction, i.e. at its top side which has to be opened for filling and to be closed after filling. Because of the different size of the bags, the top of the bag is not opened accurately, i.e. it is opened not enough, so that a part of the product to be filled into the bag is dumped next to the bag. Further, because of the different size, the closing of the top side will not be executed in an accurate manner, so that no accurate sealing is available some times.

OBJECTS OF THE INVENTION

It is therefore an object of the present invention to provide an improved bag-puckering system for a filling machine.

Another object is the provision of such an improved bag-puckering system for a filling machine that overcomes the above-given disadvantages, in particular that is able to open and close the top side of the bag in an accurate manner, in order to obviate a fault filling or a fault sealing of the bag, although the alternating bags have different sizes, more particularly at their top sides.

A further object is to provide a bag-puckering system that allows the bags to follow one another closely through the filling machine, thereby reducing the footprint of the equipment.

SUMMARY OF THE INVENTION

A bag-puckering system has according to the invention a plurality of pairs of grippers engageable with upper corners of respective bags. The grippers of each pair are shiftable between a relatively close inner position in which the respective bag is puckered open and a more widely spaced outer position in which the respective bag is held flat. The pairs of grippers are aligned in a longitudinal row and shiftable in a travel direction through a filling station wherein fluent material can be poured into the bags. A controller upstream of the filling station measures a length in the direction of the bags and generates respective outputs corresponding thereto. A movable cam at the filling station operatively engages the grippers in the filling station for shifting the grippers between their inner and outer positions. A drive connected to the control means and to the cam can shift the grippers in accordance with the size of the respective bags.

Advantageously the evaluation and control device determines the size, more particular the transverse size, preferably the size of the top of each bag feed into the puckering system, generating a slideway signal corresponding to the evaluated size and that is sent to the drive for controlling the drive. The drive moves of the bag grippers of each of the pair of bag grippers by means of the pucker cam so that the pucker cam is actuated forward and backward through a stroke determined by the generated slideway signal. With the invention the actuated slideway amount can be different from one bag to the following one, so that each bag is opened or closed in an accurate manner, in order to prevent fault filling or fault sealing.

In a preferred embodiment the first and second rails are mounted on a common base. This causes a parallel movement of the first and second rails. In a further embodiment the first and second rails can be separate and moveable relative to each other. In both embodiments the movement is actuated by the drive, and the extent of transverse shifting is determined by the evaluation and control device.

The first and second rails can be designed with an equal dimension respectively in a longitudinal direction. In a preferred embodiment the back rail has a longitudinal dimension that is longer than the longitudinal dimension of the front rail. In this preferred embodiment the longer rail of both projects above the shorter one of both preferably at one side only.

The process of opening and closing the top of the bag is accomplished by the use of uniquely designed bag grippers, each one holding opposing top corners of the bag in spring-loaded jaws. The jaw assemblies are mounted on pivot shafts which allow the jaws to be pivoted toward each other, reducing the distance between them. A torsion spring prestresses the jaws to the outer position against a stop pin. At the bottom of the pivot shaft a pivot cam arm is mounted that is used to push and hold the jaws in the inner puckered-bag position for filling. Each arm has two rollers, one of the top to ride on a fixed cam in the filling station to hold the bag gripper in the puckered position and one mounted to the bottom of the arm used to actuate the bag gripper into and out of the inner puckered-bag position. These arms alternate between pairs of bag grippers with the lower roller directly under the top roller (short arms) or at the opposite end from the top roller (long arms).

The bag grippers cycle around the machine on a chain driven by a conveyor drive and bag grippers are equally spaced around the entire drive conveyor. Each alternating pair of bag grippers has either long or short arm style pivot cam arms. Each bag gripper pair consists of an upstream and downstream bag gripper to hold the top corners of the bag and each pair has either long pivot arms or short pivot arms. All pairs have identical top rollers so they can be retained in the inner puckered-bag position on the one common rail, but the lower rollers either are at the front (to be pushed back to pivot the bag gripper jaws to the inner puckered-bag position) or at the rear (to be pulled forward to pivot the bag gripper jaws to the inner puckered-bag position). This allows the cams that actuate one pair of grippers to the inner puckered-bag position to have no affect on the upstream or downstream pair of grippers allowing the cams to alternate for each pair of grippers.

The pucker cam consists of the first or front rail and the second or rear rail mounted preferably on a common base. The cam is actuated forward and backward as the bag gripper lower rollers enter the gap between the two rails. The front rail can be moved to a position aligned with the fixed cam in the filling station.

As the pucker cam pushes backward on the lower rollers of a short-arm gripper pair the bag gripper jaws move toward each other causing the bag to go into the puckered or open condition. As the pucker cam pulls out forward on the lower rollers of a long-arm gripper pair it moves the respective bag gripper jaws toward each other causing the bag to also move into the puckered or open condition.

In a preferred embodiment the evaluation and control device is located upstream of a first pucker cam, a fixed pucker cam being provided downstream of the first pucker cam actuated by the first drive. A second pucker cam preferably actuated by a second drive is located downstream of the fixed pucker cam or guide. This second pucker cam cycles opposite to the first pucker cam, and the first and second drives are both controlled by the evaluation and controlling device. This ensures that the bag is opened in an accurate manner by the first or infeed pucker cam and is closed in an accurate manner by the second or outfeed pucker cam, the slideway travel being set by the evaluation and control device as described above.

Further the normal method for bag puckering in bag grippers requires a greater distance between the trailing gripper of the leading pair and the leading gripper of the trailing pair so as to not affect the next bag gripper pair when actuating the preceding pair. The alternating long pivot arm and short pivot arm technique allows the trailing gripper of the leading pair to be directly next the leading gripper of the trailing pair as the actuation of the leading bag gripper pair has no effect on the trailing bag gripper pair. The use of the upper guide roller being the same on both short pivot arm pairs and long pivot arm pairs allows the use of preferably one common fixed pucker guide to hold both pairs of bags in the inner puckered-bag position through the filling section of the machine, making for more accurate and efficient adjustment. This also allows the pucker cams to alternatively cycle reducing the motion and cycle distance in half and the wear and tear on the components and a much gentler motion making the machine quieter and smoother.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
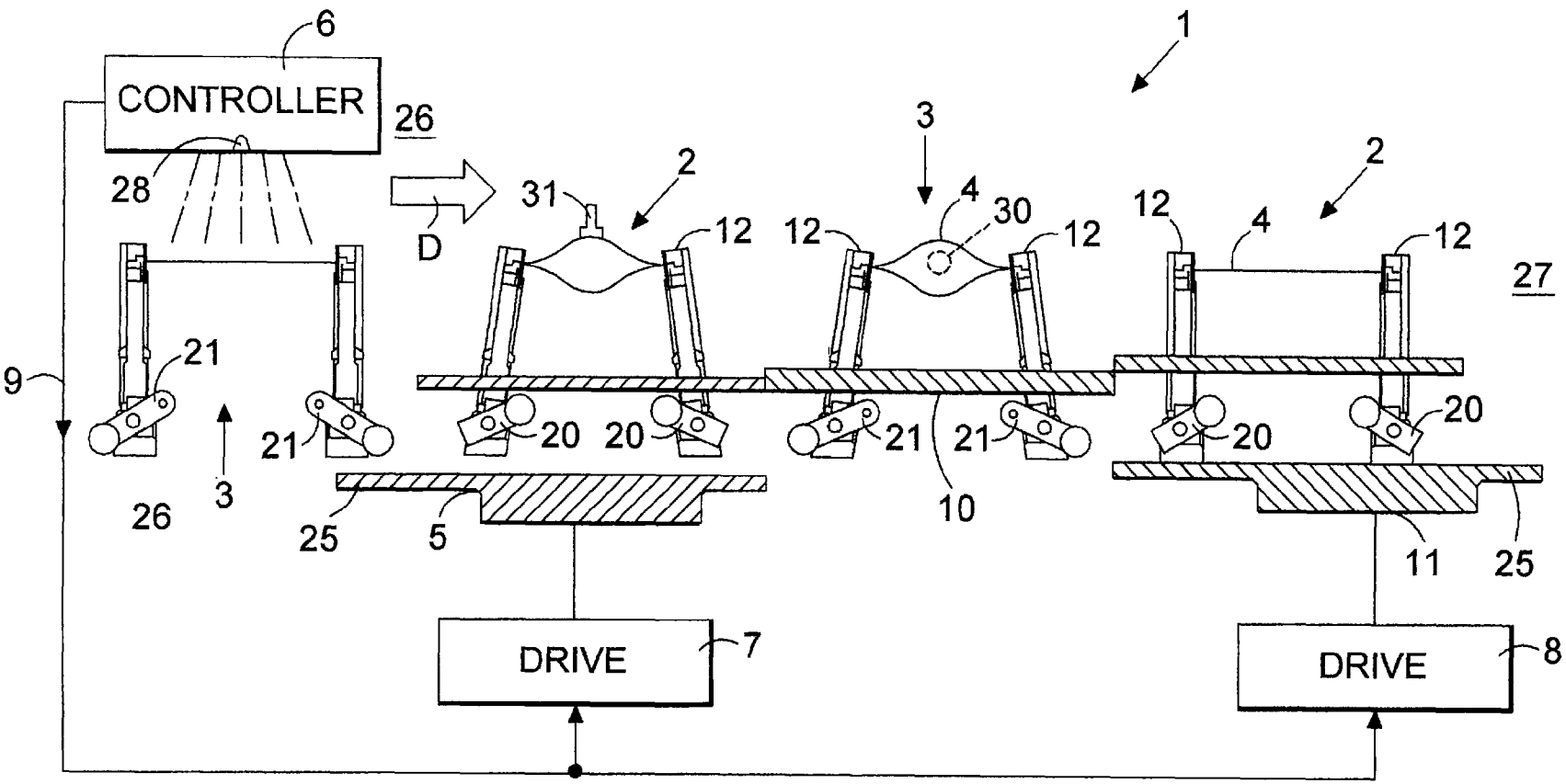
FIG. 1 shows a bag puckering system according to the invention.

As seen in FIG. 1 the bag puckering system 1 comprises bag gripper pairs 2 and 3, which will be described later on. Each bag gripper pair 2 and 3 holds a bag 4 at opposing top corners. A first or infeed pucker cam 5 is located downstream of an evaluation and control device 6. The evaluation and control device 6 is connected by a line 9 to drives 7 and 8. The connection 9 can be wireless or by wire.

The evaluation and control device 6 evaluates the size of the top of each bag 4 as it passes and generates a slideway signal 9 corresponding to the size of the respective bag 4. The top size is determined by an appropriate sensor 28. The slideway signal is sent through the line 9 to the drive 7 that converts it into a transverse shift of the cam 5 appropriate for the passing bag 4. This process ensures that each bag 4 is opened in an accurate manner according to the actual size of the bag 4.

A stationary pucker guide 10 is located downstream of the first or infeed pucker cam 5. A second or outfeed pucker cam 11 is located downstream of the pucker guide 10. The second or outfeed pucker cam 11 is connected to a drive 8 also connected by the signal line to the evaluation and control device 6. The second or outfeed pucker cam 11 is acted by the drive 8 with the slideway amount corresponding to the slideway signal set by the controller 6 for the current bag 4. This ensures that each bag 4 is closed in an accurate manner according to the actual size of the respective bag 4.

Figure 2:
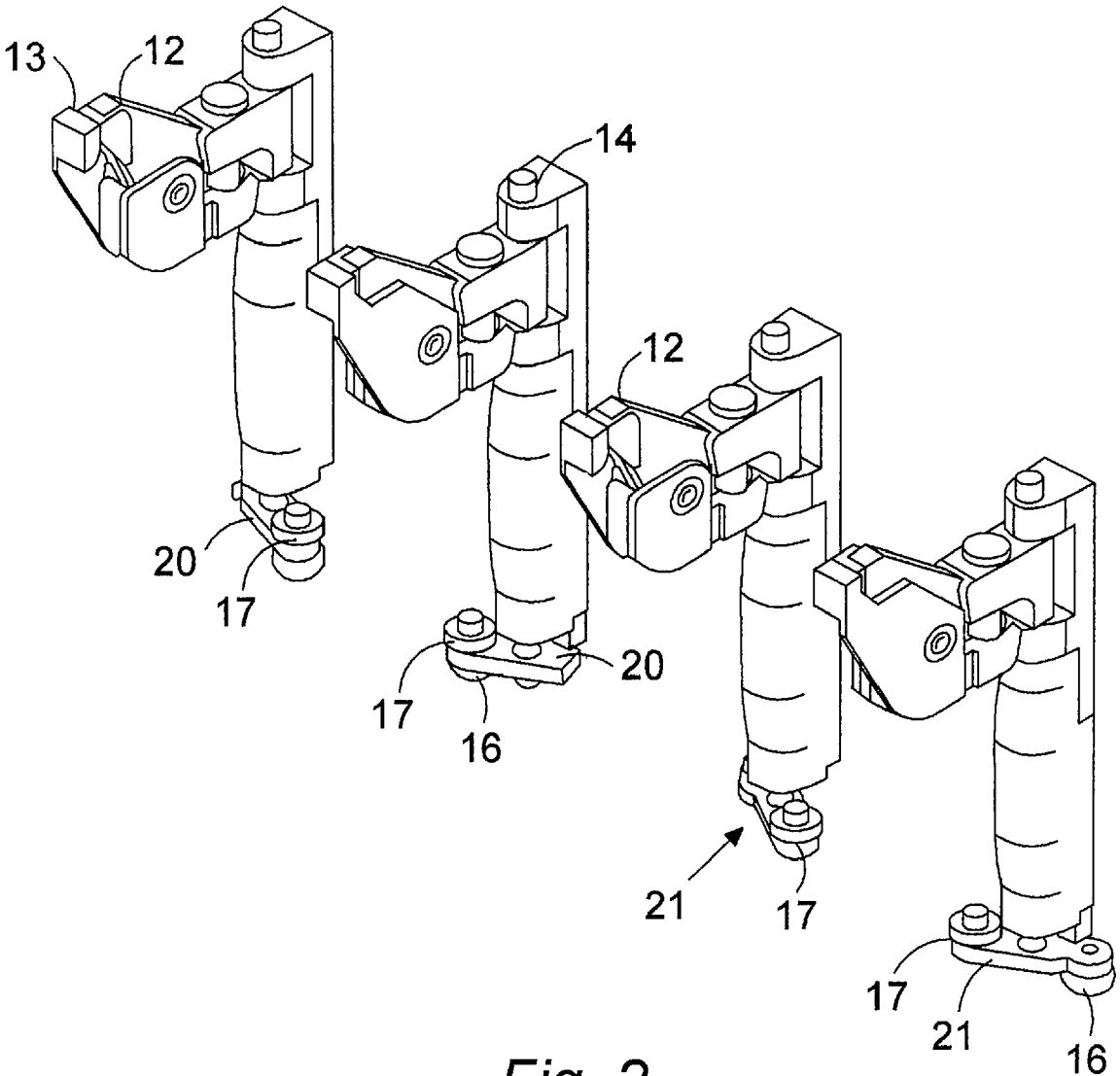
FIG. 2 shows two bag gripper pairs in detail.

The process of opening and closing is accomplished by the use of uniquely designed bag grippers 12 (FIG. 2), each one holding opposing top corners of the bag 4 in spring loaded jaws 13. The grippers 12 are each mounted on a vertical pivot shaft 14 that allows the grippers 13 to be pivoted toward each other about respective vertical axis, reducing the distance between them. Torsion springs 29 (FIG. 6B) prestress the grippers 12 jaws 13 against respective unillustrated abutments to a position projecting perpendicular to a normal displacement direction D. The grippers 12 are connected together, for instance by a chain with an even number of pairs 2 and 3 in a closed loop passing in the direction D through a filling machine having a spout illustrated schematically at 30 in FIG. 1. In addition suction grippers such as shown at 31 travel through the filling machine with the bags to hold them open so that fluent material, normally particulate, can be poured from the spout 30 into the open bags 4.

The pivot shafts 14 of the grippers 12 of the pairs 2 carry short or single arms 20 that each have an outer end carrying a lower roller 16 and an upper roller 17. The pivot shafts 14 of the grippers 12 of the pairs 3 carry long double arms each having a lower roll 16 at one end and an upper roll 17 at the opposite end, diametrally opposite relative to the respective shafts 14. Pushing of the lower rollers 16 of the pairs 2 transversely rearward (up in FIG. 1) rotates the grippers 12 of each of the pairs 2 toward each other to pucker the respective bag and pushing the lower rollers 16 transversely forward (down in FIG. 1) rotates the grippers 3 of the pairs 3 similarly.

The bag grippers 12 move in a closed annular path around the machine driven by a conveyor drive and the bag grippers 12 are equally spaced around the entire drive conveyor. Each alternating pair 2 or 3 of bag grippers 12 has either long 21 or short arm 20 style pivot cam arms 15. The bag grippers 12 of each pair 2 and 3 hold the top corners of a respective one of the bags 4 and each pair 2 and 3. All the top rollers 17 are positioned on one transverse side of the travel path so they can be retained in the inner puckered-bag position on a common fixed cam 10 at the filling station defined by the spout 31.

Figure 4:
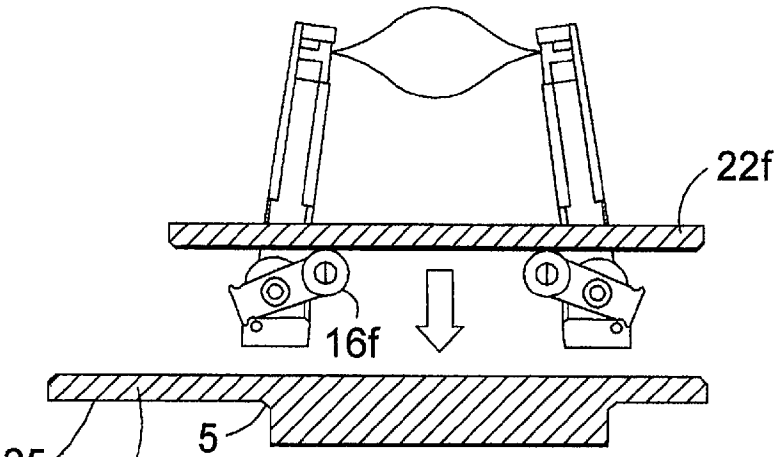
FIG. 4 shows a single short-arm gripper pair in detail engaging the pucker cam.
Figure 5:
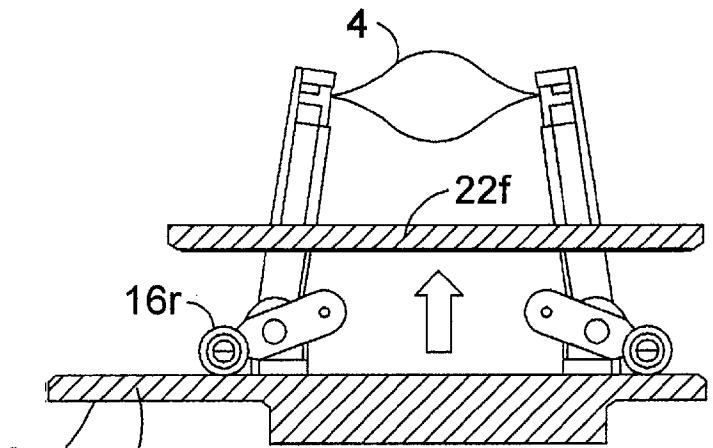
FIG. 5 shows a single long-arm gripper pair in detail engaging the pucker cam.
Figure 3:
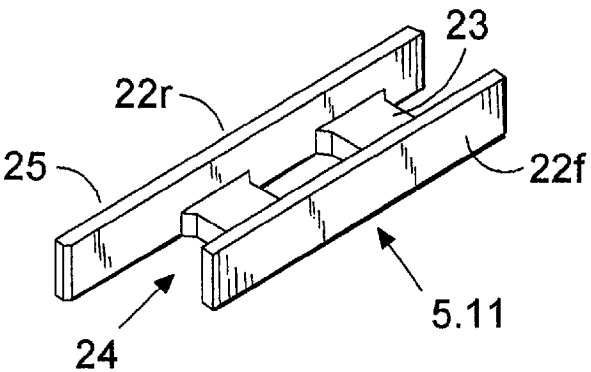
FIG. 3 shows a single pucker cam in detail.

The lower rollers 16 either are at the front so they can be pushed back to pivot the bag grippers of the pairs 2 to the inner puckered-bag position or at the rear so they can be pulled forward to pivot the bag grippers of the pairs 3 to the inner puckered-bag position. To this end the pucker cams 5 and 11 shown in FIGS. 3 and 4 are each provided with a back cam bar 22*r* and a front cam bar 22*f* fixed together by transverse connectors 23. The cams 5 and 11 are pushed alternately back and forth as the pairs 2 and 3 of grippers 12 pass. The rear bar 22*r* of both cam assemblies 5 and 11 is longer to project at 25 past the bar 10 than the respective front bar 22*f*.

These cam bars 22*f* and 22*r* are situated at a level of the lower rollers 16 and are not engageable with the upper rollers 17. On the other hand, the cam 17 is situated at the level of the upper rollers 17 and is not engageable with the lower rollers 16.

More particularly the machine is operated as shown in FIGS. 6A-12C. In FIGS. 6B, 7B, 8B, 9B, 10B, 11B and 12B no bags 4 are shown for clarity of view.

Figure 6A:
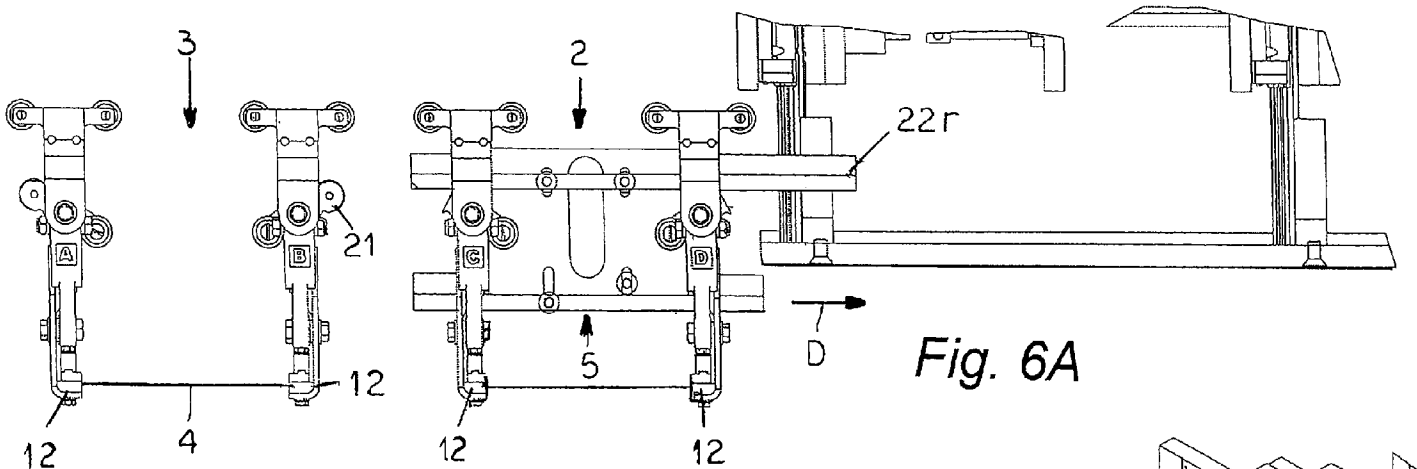
FIG. 6A is a top view of the puckering system in a first position.
Figure 6B:
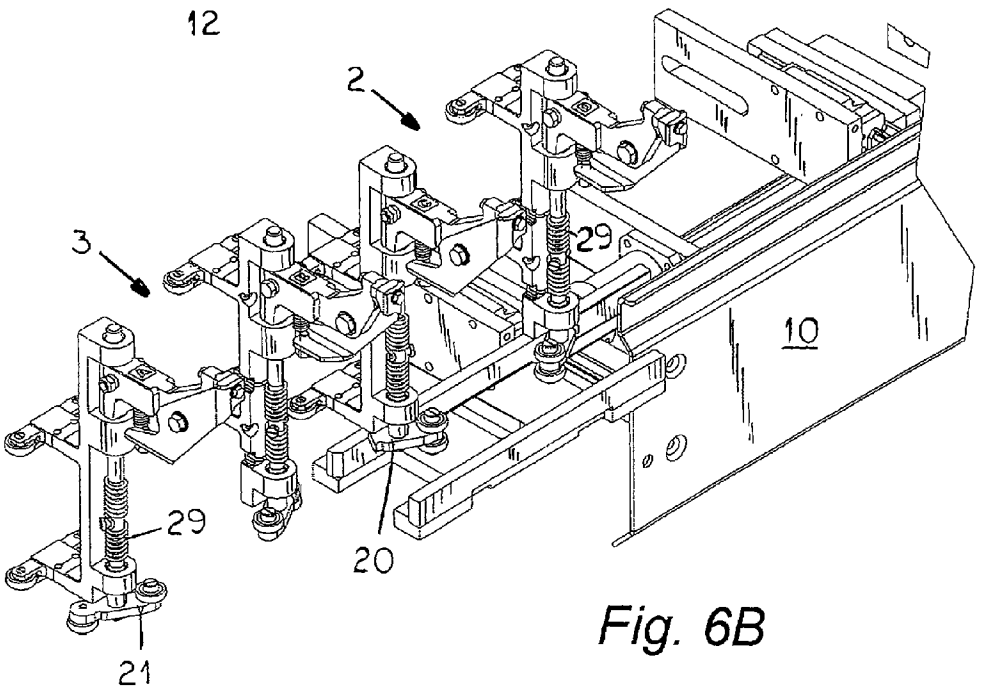
FIG. 6B is a perspective view of the structure as in FIG. 6A.
Figure 6C:
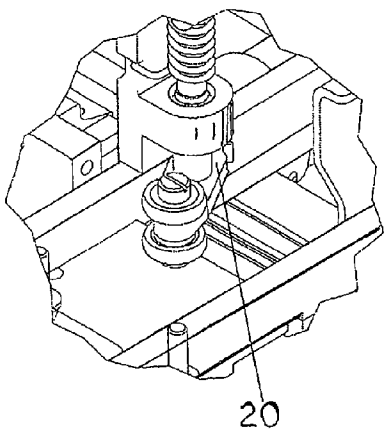
FIG. 6C is a large-scale view of a detail of FIG. 6B.

FIGS. 6A-6C show a starting position where the leading pair 2 and trailing pair 3 of grippers 12 are both in their starting position extending perpendicular to the travel direction D. A bag 4 is held tight and taut in each of the pairs 2 and 3, lying in a vertical plane parallel to the direction D. The cam assembly 5 is out of engagement with the rollers 16 and 17.

Figure 7A:
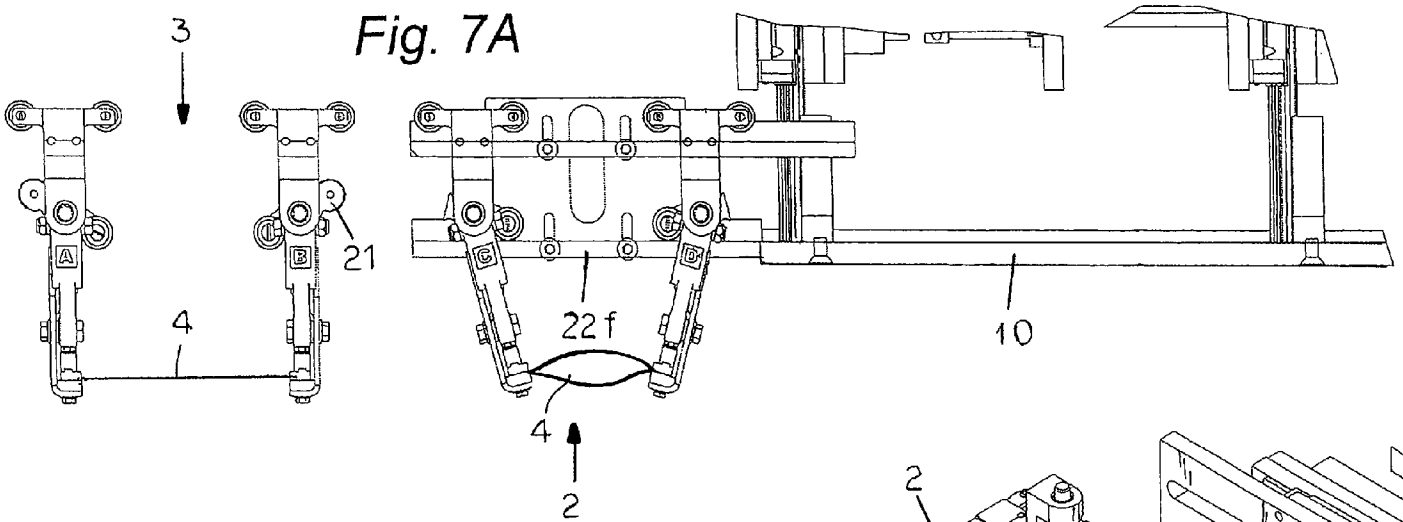
FIGS. 7A-7C, 8A-8C, 9A-9C, 10A-10C, 11A-11C, and 12A-12C are views like respective FIGS. 6A-C but showing the system in successive operational positions.
Figure 7C:
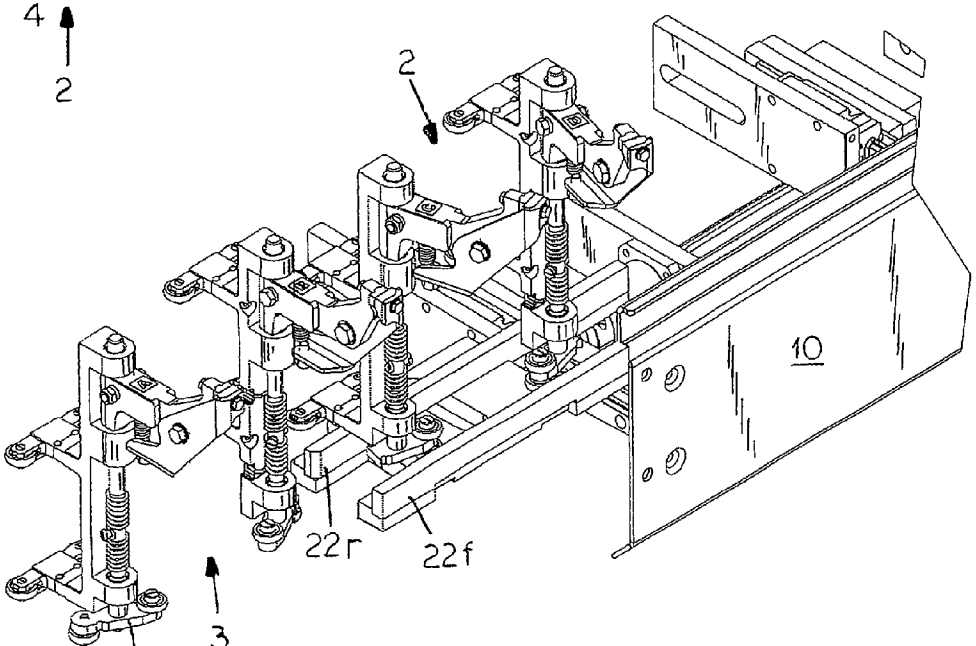
Figure 7B:
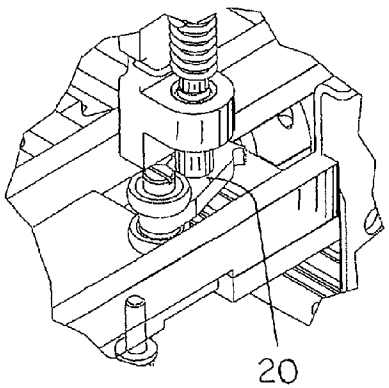
Figure 8A:
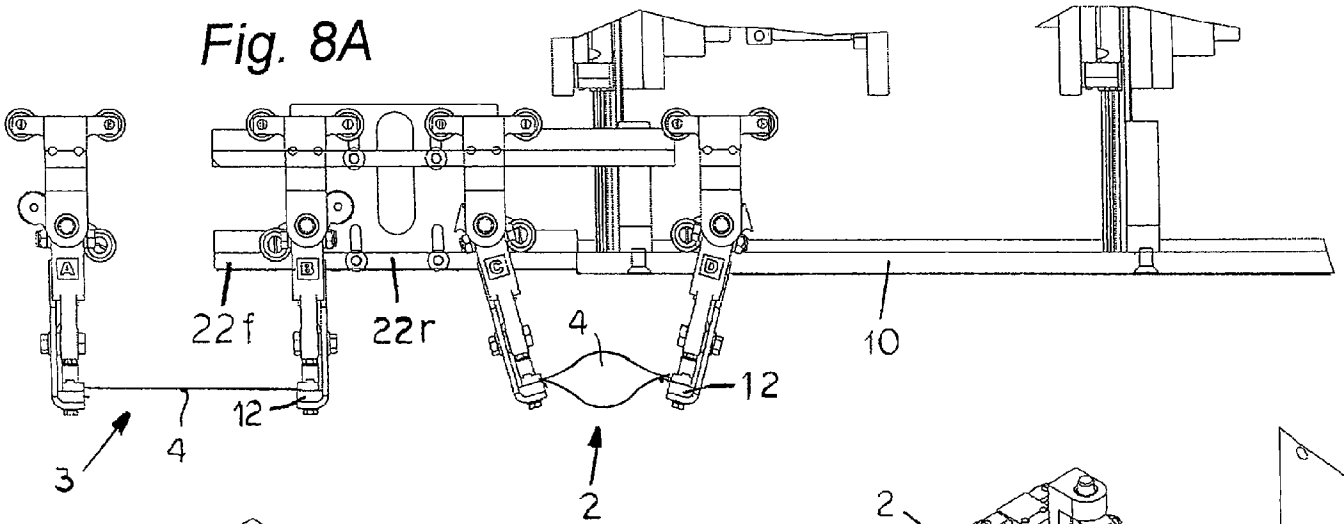
Figure 8B:
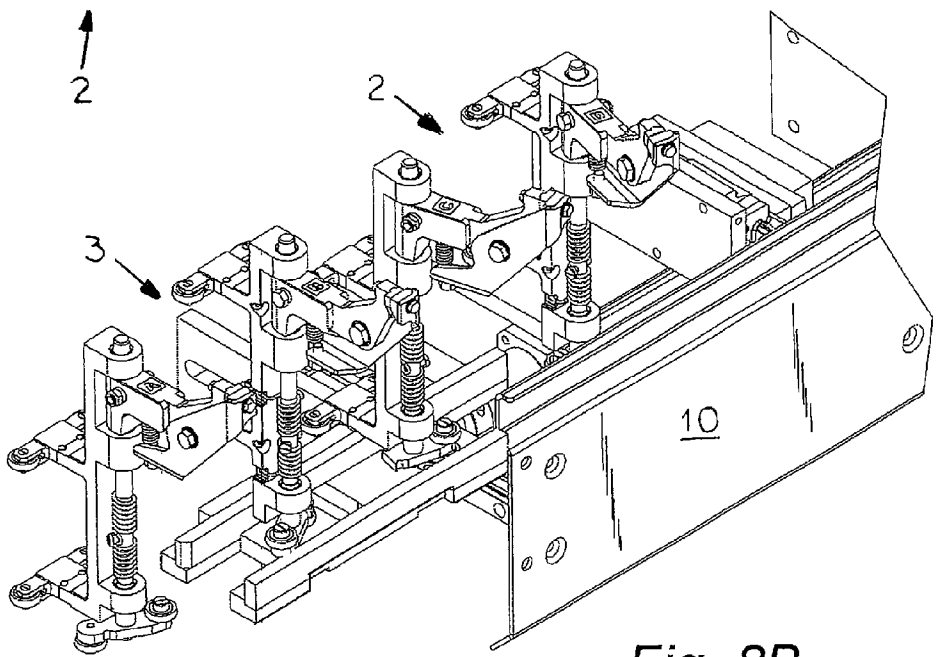
Figure 8C:
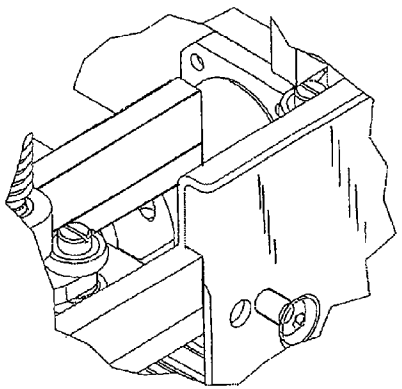
Figure 9A:
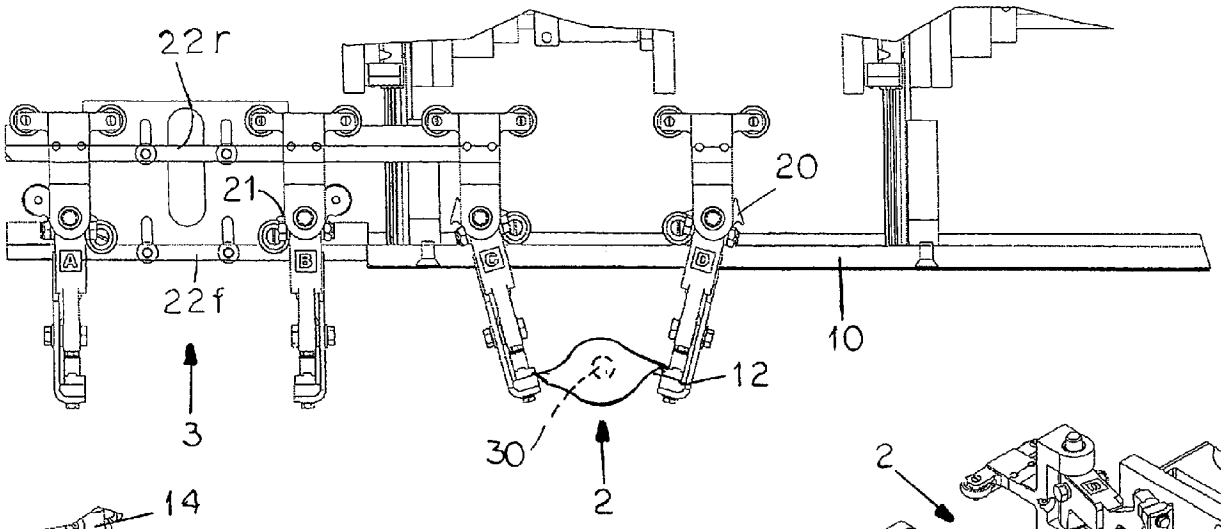
Figure 9B:
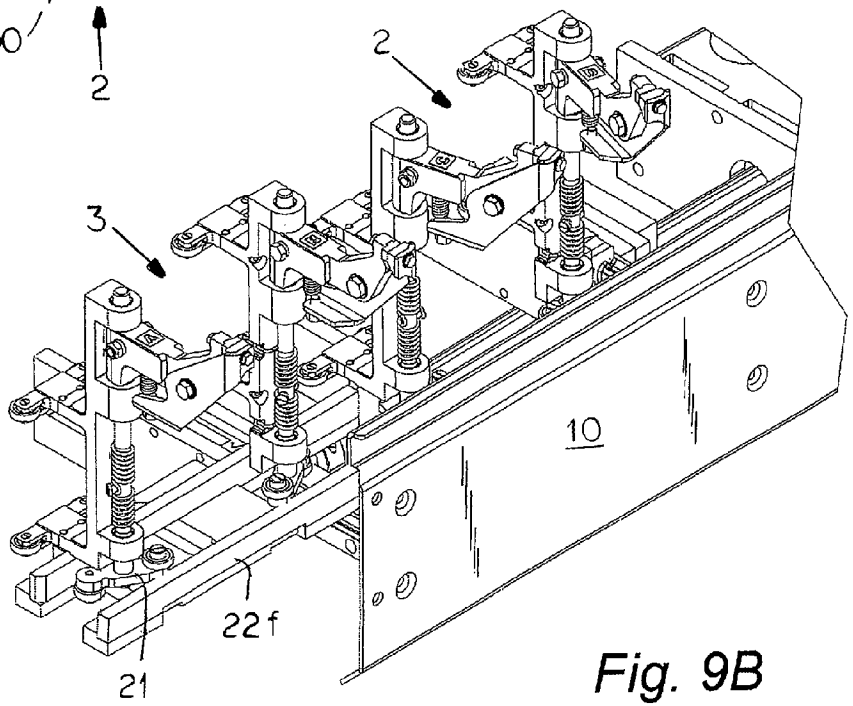
Figure 9C:
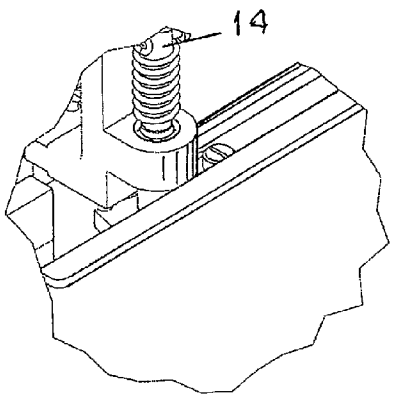

FIGS. 7A-7*c* show how, as the leading pair 2 moves downstream and approaches the fixed cam bar 10, the cam 5 is pushed rearward so that the bar 22*f* engages the rollers 16 of the pair 2 and pushes them back, thereby pivoting in the respective grippers 2 and puckering open the respective bag 4, which action may be assisted by transversely movable suction cups such as shown in FIG. 1 at 31. The bar 22*f* is pushed back until its rear face is level with the rear face of the fixed cam bar 10. On further shifting downstream the downstream gripper 12 moves from a position with its lower rollers on the cam bar 22*f* to one with its coaxial upper rollers 17 riding on the fixed cam bar 10, in which position the bag 4 is held open. Then as shown in FIGS. 9A-9C the upper roller 17 of the downstream gripper 12 of the pair 2 rolls onto the bar 10. The puckered-open bag 4 passes through a position under the fill spout 30 so the respective bag can be filled with product.

Figure 10A:
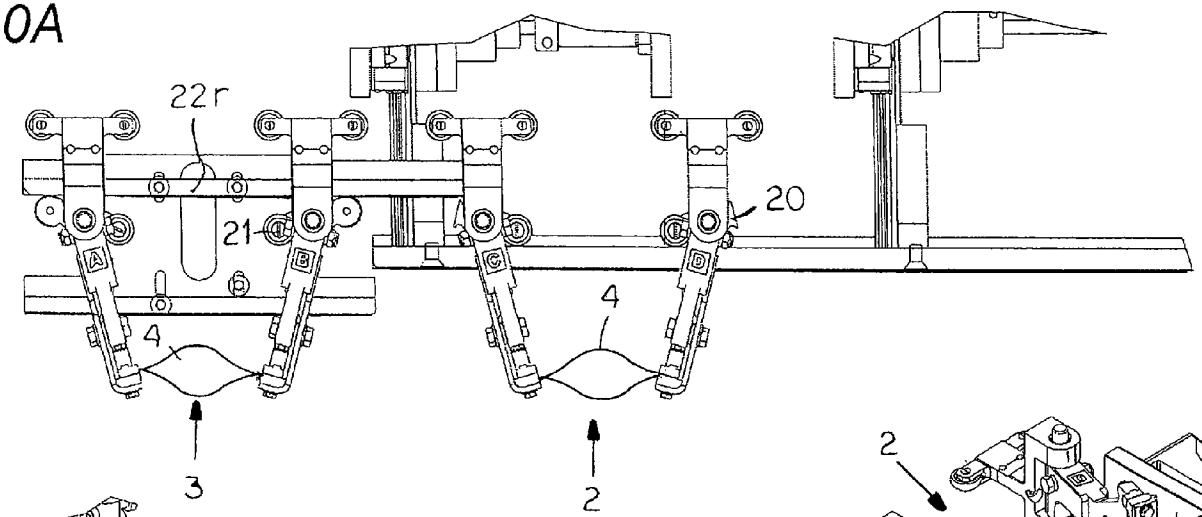
Figure 10B:
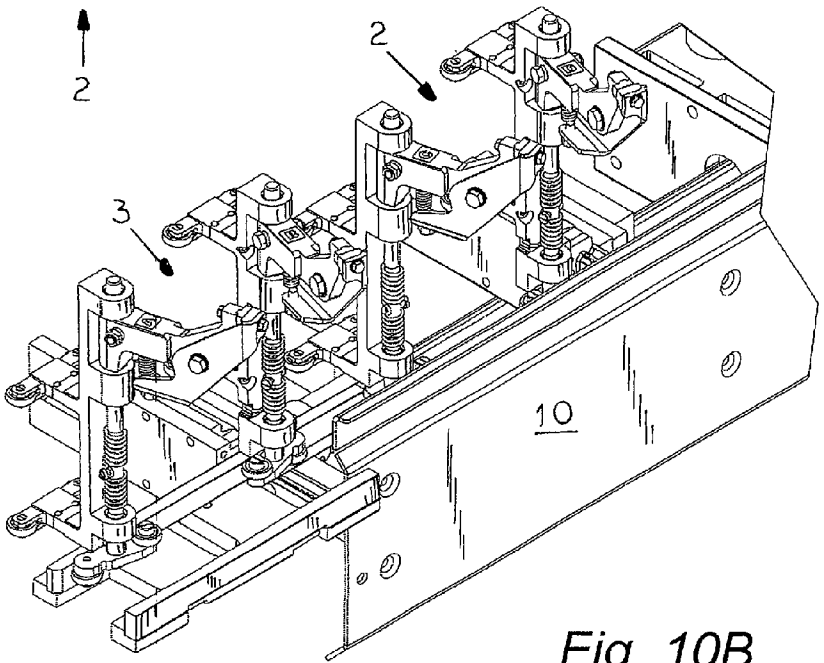
Figure 10C:
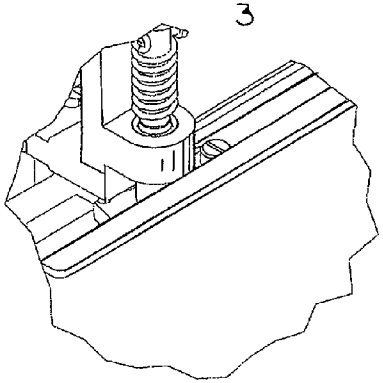
Figures 11A, 11B, 11C:
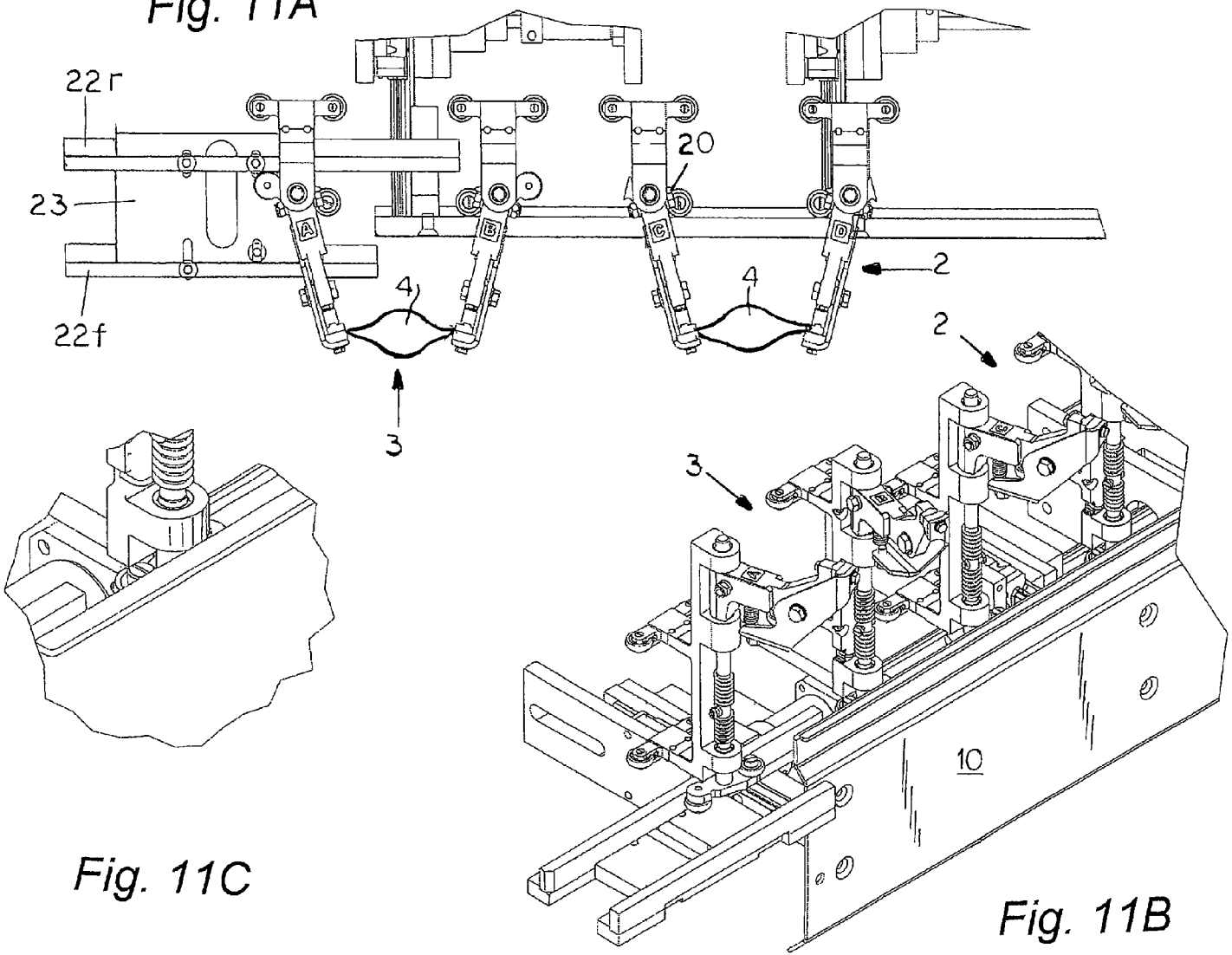
Figures 12A, 12B, 12C:
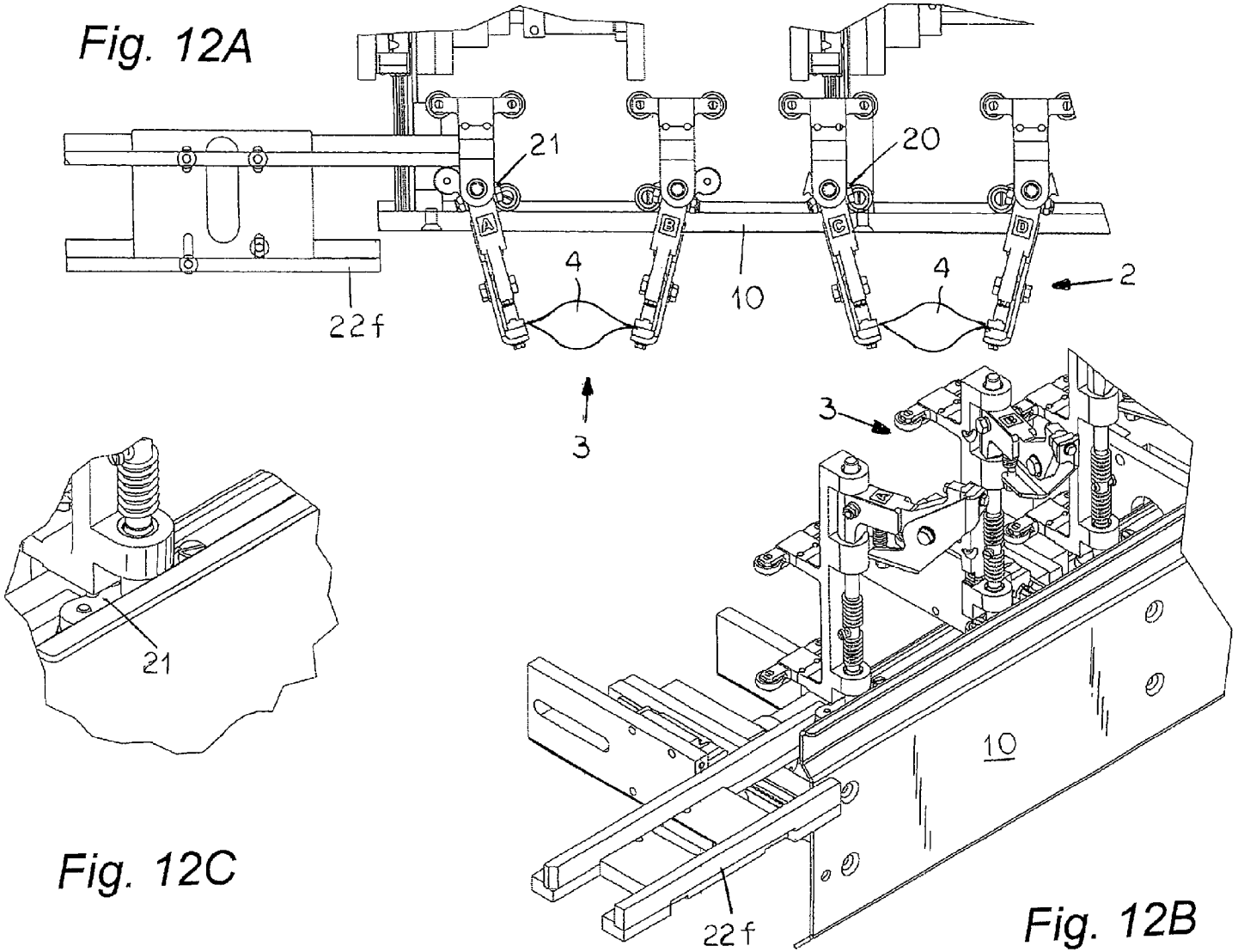

Subsequently as shown in FIGS. 10A-10C the cam 5 is shifted transversely oppositely, that is forward, so as to bring its rear bar 22*r* into engagement with the lower rollers of the downstream pair 3 of grippers 3, shifting them into a position with the respective bag puckered. Then the downstream gripper of the trailing pair 3 will move with its upper roller 17 onto the bar 10 as shown in FIGS. 11A-11C and then as shown in FIGS. 12A-12C, the upper roller 17 of the trailing gripper 12 of the downstream pair 3 will roll onto the bar 10 for filling of its bag 4.

As the gripper pairs 2 and 3 move to the downstream end of the bar 10 they travel off onto a downstream cam assembly 11 (FIG. 1) that functions oppositely to the upstream cam assembly 5 in that it spreads the grippers 12 and closes the bags 4 so they can be sealed, which action is assisted by the respective torsion springs 29.

Because the gripper pairs 2 that are operated from the front alternate with gripper pairs 3 that are operated from the back, the trailing gripper 12 of each pair 2 or 3 can be quite close to the leading gripper 12 of the following pair 3 or 2, allowing the bags 4 to be quite closely spaced along the travel path.

I claim:

1. A bag-puckering system comprising:

a plurality of pairs of grippers engageable with upper corners of respective bags, the grippers of each pair being shiftable between a relatively close inner position in which the respective bag is puckered open and a more widely spaced outer position in which the respective bag is held flat, the pairs of grippers being aligned in a longitudinal row and being shiftable in a travel direction through a filling station;

means at the filling station for pouring fluent material into a one of the bags therein;

control means upstream of the filling station for measuring a length in the direction of the bags and for generating respective outputs corresponding thereto;

a movable cam at the filling station operatively engageable with the grippers in the filling station for shifting the grippers between their inner and outer positions; and drive means connected to the control means and to the cam for shifting the grippers in accordance with the size of the respective bags.

2. The bag-puckering system defined in claim 1 wherein each gripper has a pair of rollers, the system further comprising:

a fixed cam at the filling station engageable with one of the rollers of each of the pairs of rollers to hold the respective grippers in the inner position in the filling station but not engageable with the other roller of each pair of rollers.

3. The bag-puckering system defined in claim 2 wherein the other roller of each pair is engageable with the movable cam but not with the fixed cam.

4. The bag-puckering system defined in claim 3 wherein the roller pairs include roller pairs with long arms with the respective rollers at opposite ends of the respective arms and pairs alternating with the long-arm pairs and having short arms each with both the respective rollers at the same outer end.

5. The bag-puckering system defined in claim 4 wherein the arms are pivotal about respective axes with the respective grippers.

6. The bag-puckering system defined in claim 5 wherein the pivot axes of the long arms lie between the respective rollers.

7. The bag-puckering system defined in claim 6 wherein the movable cam includes a rear cam bar engageable with the other rollers of the long-arm grippers and a front cam bar engageable with the other rollers of the short-arm grippers.

8. The bag-puckering system defined in claim 2 wherein a second such movable cam operable by the control means is provided downstream of the fixed cam.

9. A bag-puckering system comprising:

a plurality of pairs of grippers engageable with upper corners of respective bags, the grippers of each pair being pivotal about respective axes between a relatively close inner position in which the respective bag is puckered open and a more widely spaced outer position in which the respective bag is held flat, the pairs of grippers being aligned in a longitudinal row and being shiftable in a travel direction through a filling station;

means at the filling station for pouring fluent material into one of the bags therein;

a respective long arm fixed rotationally to each of the grippers of every other pair of grippers and having a pair of opposite ends projecting diametrally oppositely from the respective axis;

respective upper and lower rollers on the ends of the long arms;

a respective short arm fixed rotationally to each of the grippers of the pairs of grippers between the grippers with the long arms and extending radially from the respective pivot axes;

a respective pair of coaxial upper and lower rollers on an outer end of each of the short arms, all the upper rollers being generally coplanar at least adjacent the filling station and all the lower rollers being below the respective upper rollers and generally coplanar at least adjacent the filling station;

a fixed cam in the filling station engageable with one of the upper and lower rollers of each gripper as same passes through the filling station for holding the respective gripper in the filling station in the inner position as it passes through the filling station;

a movable cam upstream of the filling station having a pair of transversely spaced bars and shiftable transversely to engage the other rollers of each of the grippers upstream of the station and shift the respective gripper into the inner position upstream of the filling station; and means for alternately transversely shifting the movable cam for engaging the bars against the other rollers of each pair of grippers as the respective grippers approach the filling station.

* * * * *